US008660442B2

(12) United States Patent
Spink et al.

(10) Patent No.: US 8,660,442 B2
(45) Date of Patent: Feb. 25, 2014

(54) METHOD AND APPARATUS FOR PREMATURE CONSUMABLE REPLACEMENT DETECTION ON PRINTING SYSTEMS

(75) Inventors: Timothy David Jonathan Spink, Welwyn (GB); Dennis Gregory Gerbasi, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 311 days.

(21) Appl. No.: 13/285,801

(22) Filed: Oct. 31, 2011

(65) Prior Publication Data

US 2013/0108285 A1 May 2, 2013

(51) Int. Cl.
*G03G 15/00* (2006.01)

(52) U.S. Cl.
USPC ..... 399/24; 399/25; 399/27; 399/31

(58) Field of Classification Search
USPC ..... 399/9, 24–31
See application file for complete search history.

(56) References Cited

U.S. PATENT DOCUMENTS

| | | | | |
|---|---|---|---|---|
| 5,225,873 | A | 7/1993 | Lux et al. | |
| 5,918,085 | A | 6/1999 | Rollins et al. | |
| 6,016,409 | A | 1/2000 | Beard et al. | |
| 6,532,351 | B2 | 3/2003 | Richards et al. | |
| 7,146,114 | B2 | 12/2006 | Frankel et al. | |
| 7,263,300 | B2 * | 8/2007 | Ishii et al. | 399/27 |
| 7,526,215 | B2 | 4/2009 | Moodie et al. | |
| 7,978,986 | B2 * | 7/2011 | Tanaka | 399/24 |

* cited by examiner

*Primary Examiner* — Hoan Tran
(74) *Attorney, Agent, or Firm* — Ronald E. Prass, Jr.; Prass LLP

(57) ABSTRACT

According to aspects of the embodiments, there is provided an apparatus and method to detect when a consumable such as a toner bottle is replaced before end of life (EOL), throwing out toner that could be used for future printing incurs a cost. In metered accounts, the supplier incurs the cost of this waste. This disclosed process proposes monitoring the approximate rate of toner and then calculating the average amount of consumption per bottle since the last time the bottle was detected as empty. This then determines the toner consumption per bottle yield rate. Yield rate (YR) is calculated based on the estimated amount of toner delivered from a known bottle quantity at the point when the current bottle goes empty. The yield rate is displayed as a gauge on the user interface of the printer.

20 Claims, 4 Drawing Sheets

METHOD AND APPARATUS FOR PREMATURE CONSUMABLE REPLACEMENT DETECTION ON PRINTING SYSTEMS

BACKGROUND

This disclosure relates in general to copier/printers, and more particularly, to predicting when a consumable unit has been prematurely replaced.

Many machines have replaceable sub-assemblies. These subassemblies may be arranged as unit called a cartridge, and if intended for replacement by the customer or machine owner, may be referred to as a customer replaceable unit (CRU). Examples of a CRU may include printer cartridge, toner cartridge or bottle, transfer assembly unit, photo conductive imaging unit, transfer roller, fuser or drum oil unit, and the like. It may be desirable for a CRU design to vary over the course of time due to manufacturing changes or to solve post-launch problems with the machine, the CRU, or a CRU and machine interaction. It is known to provide the CRU with a monitoring device commonly referred to as a CRUM (Customer Replaceable Unit Monitor). A CRUM is typically a memory device, such as a ROM, EEPROM, SRAM, or other suitable non-volatile memory device, provided in or on the cartridge. Information identifying the CRU is written on the EEPROM during manufacture of the CRUM. For example, information identifying a CRU as a developer cartridge and identifying the type of carrier, developer, and transfer mechanism contained in the developer cartridge may be written in the memory contained in the CRUM. When a CRU containing such a CRUM is installed in a machine, the machine's control unit reads the identifying information stored in the CRUM.

Some units such as toner bottle do not have electronic CRUMs for specifically monitoring component life. In normal operations the user is informed to change the unit or bottle when it runs out of material. However, some users will change the bottle before it runs out, i.e., prematurely. The reason is not understood. In the case of toner, on the average a user tends to replace a bottle with twenty percent (20%) of toner material contained therein. May be the user has a long print run that they to run overnight. May be the user wants to keep the consumable topped-up. Regardless of the rational the premature replacement of a consumable increases waste and cost since premature replacement discards the remaining lifetime of the replaced component and since premature replacement results in frequent system shut-downs for each replacement operation.

On a CRUMless system, the memory that manages the tone gauge resides on the printer machine, thus, it is not possible to instantly detect if a bottle is replaced prematurely. However, it is possible to detect toner rate of consumption and amount of consumption since the last time the bottle was changed. It is also possible to detect out-of-toner when the bottle is empty.

For the reasons stated above, and for other reasons stated below which will become apparent to those skilled in the art upon reading and understanding the present specification there is need in the art for systems, apparatus, and/or methods to predict that a consumable has been replaced prematurely.

SUMMARY

According to aspects of the embodiments, there is provided an apparatus and method to detect when a CRUM-less toner bottle is replaced before end of life (EOL), throwing out toner that could be used for future printing incurs a cost. In metered accounts, the supplier incurs the cost of this waste. In CRUM-less systems, the printing machine cannot detect that the toner bottle has been changed. This disclosed process proposes monitoring the approximate rate of toner and then calculating the average amount of consumption per bottle since the last time the bottle was detected as empty. This then determines the toner consumption per bottle yield rate. Yield rate (YR) is calculated based on the estimated amount of toner delivered from a known bottle quantity at the point when the current bottle goes empty. The yield rate is displayed as a gauge on the user interface of the printer.

DETAILED DESCRIPTION

Figure 1:
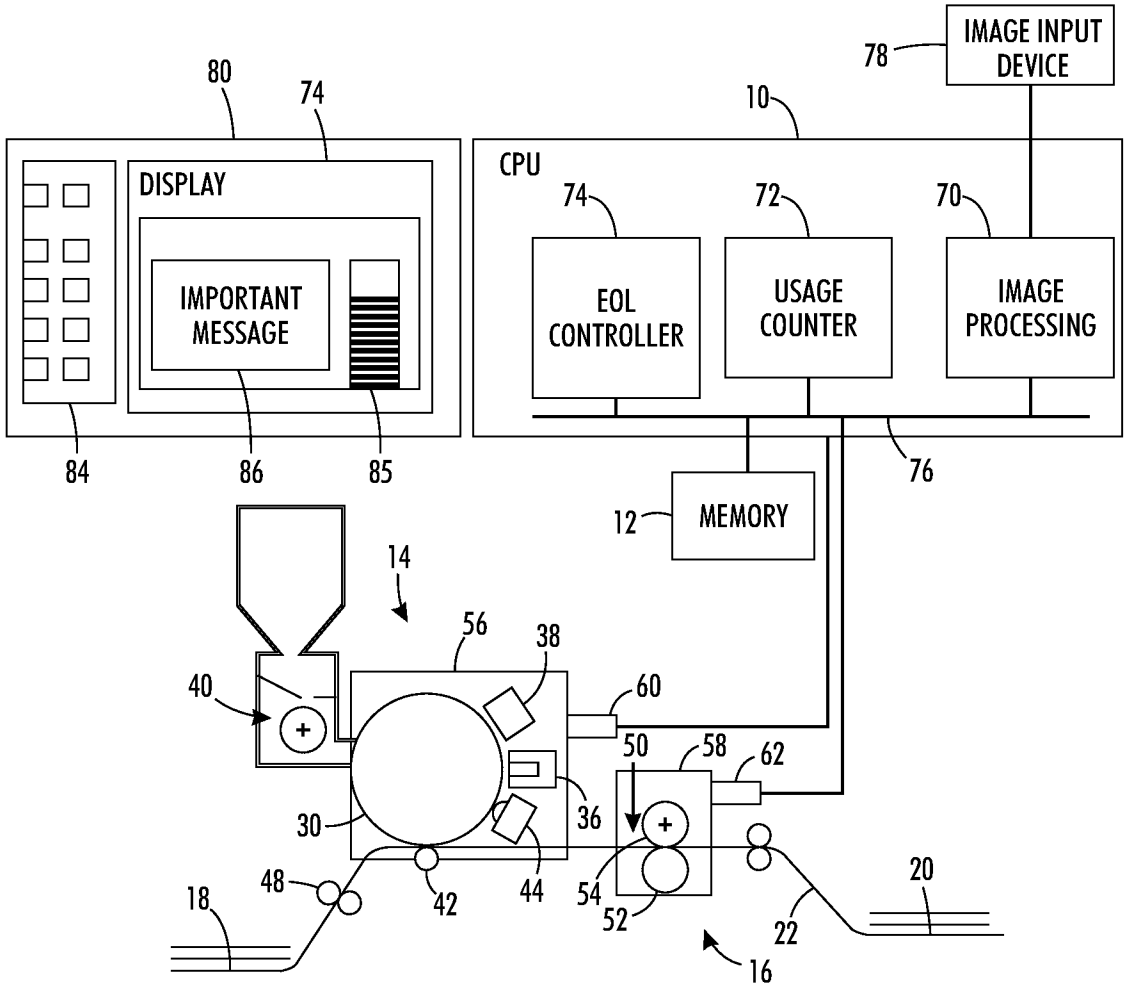
FIG. 1 illustrates an elevational view of a printer displaying of yield rate as a gauge on the user interface in accordance to an embodiment.

In accordance with various aspects described herein, systems and methods are described that facilitate the displaying of yield rate as a gauge on the user interface of a printer and the use of toner level estimations to generate a message or to take action if a user replaces toner cartridges too often without fully depleting the toner.

Aspects of the disclosed embodiments relate to a method to detect premature consumable replacement of a consumable replaceable unit in a printer, the method comprising monitoring and accumulating usage of the consumable replaceable unit in the printer; determining a yield rate from the accumulated usage of the consumable replaceable unit in the printer; generating a message indicative of premature consumable replacement if the yield rate for the consumable replaceable unit is below a certain value.

A further aspect of the disclosed embodiments relate to a method to detect premature consumable replacement of a consumable further comprising displaying the yield rate as a gauge on a printer user interface.

A further aspects of the disclosed embodiments relate to a method to detect premature consumable replacement of a consumable wherein below a certain value is less than or equal to zero.

In yet further aspects of the disclosed embodiments relate to a method to detect premature consumable replacement of a consumable wherein the message is displayed on the printer user interface A further aspect of the disclosed embodiments relate to a method to detect premature consumable replacement of a consumable wherein the generated message notifies the user that a premature consumable replacement is a potential violation of a service level agreement that exists with an enterprise.

In yet another aspect of the disclosed embodiments relate to a method to detect premature consumable replacement of a consumable wherein the consumable replaceable unit is selected from a group consisting of toner, ink, and print media.

A further aspect of the disclosed embodiments relate to a method to detect premature consumable replacement of a consumable wherein the yield rate is a function of consumption of the consumable replaceable unit, end of life value for the consumable replaceable unit, and a first and second triggering signal.

Aspects of the disclosed embodiments relate to a system to detect premature consumable replacement of a consumable replaceable unit in a printer comprising a processor; a storage device coupled to the processor, wherein the storage device comprises program instructions executable by the processor to: monitor and accumulate usage of the consumable replaceable unit in the printer; determine a yield rate from the accumulated usage of the consumable replaceable unit in the printer; generate a message indicative of premature consumable replacement if the yield rate for the consumable replaceable unit is below a certain value.

A further aspects of the disclosed embodiments relate to a printer comprising at least one replaceable module which is removable from the printer; and a processor having a first mode of operation to display, until the processor determines that an end of life value for the replaceable module is reached, a yield rate gauge for the at least one replaceable module and a second mode of operation to display, if operation of the printer continues beyond a certain value past the end of life value for the replaceable module, a message indicative of premature consumable replacement.

A further aspect of the disclosed embodiments relate to a printer to detect premature consumable replacement of a consumable further comprising a graphical user interface in communication with the processor which displays the yield rate gauge and the message indicative of premature consumable replacement.

The term "print media" generally refers to a usually flexible, sometimes curled, physical sheet of paper, plastic, or other suitable physical print media substrate for images, whether precut or web fed.

The term "image forming machine" as used herein refers to a digital copier or printer, electrographic printer, bookmaking machine, facsimile machine, multi-function machine, or the like and can include several marking engines, as well as other print media processing units, such as paper feeders, finishers, and the like. The term "electrophotographic printing machine," is intended to encompass image reproduction machines, electrophotographic printers and copiers that employ dry toner developed on an electrophotographic receiver element.

A "network management station" refers to a monitoring device or computer that is operated by a human user to monitoring the status of the devices on a computer network such a printing system or machine. A "print management station" refers to a monitoring device or computer that is operated by a human user such as a system administrator (SA).

A "purchase" any creation of or change in a business relationship between two parties with reference to goods such as customer replaceable unit (CRU). A "purchase" can include metered machines or sold machines. Metered machines are machines sold with a service contract, which likely includes that all machine consumables (e.g., toner, ink) be supplied as part of the contract.

As used herein a consumable or "customer replaceable unit" (CRU) shall refer to any material that is consumed in the course of a printing or ancillary process. Consumables can include liquid inks, solid phase-change inks in pelletized or other forms, or toner or developer such as used in xerography. Consumables can include other materials that are consumed or used incidental to a printing process, such as release agents, lubricants for any purpose, cleaning webs, and the like.

As used herein the end of life (EOL) of a CRU is generally defined in terms of a predetermined event, such as a fixed number of copies printed by a printer after initial installation of the CRU in a printer. To provide for portability of CRUs between printers, CRUs may include a memory (a CRUM) which stores an end of life value of a parameter representing the predetermined end of life event. The end of life value is generally a maximum value (such as a maximum number of copies which can be printed), although in some cases, the end of life value may be a minimum value.

As used herein a "yield rate" shall refers to the amount of a particular consumable expressed as a percentage. The yield rate when the consumable has been depleted should be "0" percent.

The disclosed embodiments below will be described with reference to toner but it should be understood that the yield rate and premature replacement methodology is applicable to any consumable such as toner, ink stick, ink barrels, print media, and other resources well known to those in the art.

FIG. 1 a simplified, partially-elevational, partially-schematic view of an electrophotographic printer suitable for performing the method disclosed herein is shown. The printer includes a processor 10, such as a central processing unit (CPU), and a plurality of operating components under the control of the processor 10. The processor 10 may execute one or more programs of stored instructions for at least a portion of the method for detecting the premature replacement of a consumable in the printer in accordance with one aspect of the exemplary embodiment described herein and illustrated in FIG. 3 and FIG. 4. In this particular embodiment, those programmed instructions are stored in memory 12, although some or all of those programmed instructions could be stored and retrieved from and also executed at other locations, such as in an operator system coupled to the printer. A variety of different types of memory storage devices, such as a random access memory (RAM) or a read only memory (ROM) in the system or a flash drive, hard disk, CD ROM, or other computer readable medium which is read from and/or written to by a magnetic, optical, or other reading and/or writing system that is coupled to the processor 10, can be used for memory 12.

The illustrated operating components of the printer are shown in FIG. 1 as xerographic components, although it will be appreciated that in the case of an inkjet or other printing system the operation components will be suitably configured. The operating components include a marking engine 14, for applying images to print media, a fuser assembly 16, for permanently fixing the images to the print media, a paper source 18 for supply sheets of print media, a finisher 20, herein illustrated as paper trays, for receiving the printed and fused sheets, and a conveyor system 22, for conveying the print media from the paper source 18 to the marking engine 14, fuser assembly 16, and finisher 20 in turn. One or more of the operating components 14, 16, 18, 20, 22 comprises a replaceable module or CRU.

The illustrated marking engine 14 includes a charge retentive surface, such as a rotating photoreceptor 30 in the form of a belt or drum. The images are created on a surface of the photoreceptor. Disposed at various points around the circumference of the photoreceptor 30 are a charging station 36 for each of the colors to be applied (one in the case of a monochrome printer, four in the case of a CMYK printer), such as a charging corotron, an exposure station 38, such as a raster output scanner (ROS), which forms a latent image on the photoreceptor 30, a developer unit 40 which comprises a replaceable module or CRU such as toner, associated with each charging station for developing the latent image formed on the surface of the photoreceptor 30, a transferring unit 42, such as a transfer corotron, and a cleaning device 44. The imaging unit 14 may be a self contained module of the marking engine 14 and may include the photoreceptor 30. The imaging unit 14 may further include one or more of the charging station 36, exposure station 38, developer unit 40, transferring unit 42, and cleaning device 44. In the embodiment illustrated, the imaging unit 14 includes components 30, 36, 38, and 44. Paper or other print media is supplied to the marking engine 14 along a paper path from media supply trays of paper source 18. The paper is drawn from the supply trays, typically one sheet at a time, by feed rollers 48 of the conveyor system 22. The print media conveyor system 22 is controllable to acquire sheets of a selected print medium from the print media source 18, transfer each acquired sheet to the marking engine 14, to perform selected marking tasks, then to the fuser 16, and subsequently transfer each sheet to the finisher 20 to perform finishing tasks. Of course, in any particular embodiment of an electrophotographic printer, there may be variations on this general outline, such as additional corotrons, or cleaning devices, or, in the case of a color printer, multiple developer units.

The fuser assembly 16 includes elements for fusing the toner image to the print media. The fuser may include a pair of rollers 50, 52, at least one of which is driven, and which together define a nip. In the illustrated embodiment, roller 50 is a heat roller which is heated by a heater 54, such as a resistance heater, and roller 52 is a pressure roller which is biased into contact with heated roller 50. However, fusing systems based on pressure alone or other forms of electromagnetic radiation, such as UV radiation, are also contemplated. The fuser unit 16 may be a self contained module comprising one or more components of the fuser assembly 16, such as one or both of the rollers 50, 52 and heater 54.

The printer executes print jobs. Print job execution involves printing images, such as selected text, line graphics, photographs, machine ink character recognition (MICR) notation, and the like on front, back, or front and back sides or pages of one or more sheets of paper or other print media. Some sheets may be left completely blank. Some sheets may have both color and monochrome images. Execution of the print job may also involve collating the sheets in a certain order. Still further, the print job may include folding, stapling, punching holes into, or otherwise physically manipulating or binding the sheets. The printing, finishing, paper handing, and other processing operations that can be executed by the printer are determined by the capabilities of the paper source 18, marking engine(s) 14, print media conveyor 22, and finisher 20 of the printer.

In a printing operation, the photoreceptor 30 rotates and is charged at the charging station 36. The charged surface arrives at the exposure station 38, where a latent image is formed. The portion of the photoreceptor 30 on which the latent image is formed arrives at the developer unit 40, which applies a marking material, comprising toner particles and associated carrier particles, to the latent image to obtain a toner image. The developed image moves with the photoreceptor 30 to the transferring unit 42, which transfers the toner image thus formed to the surface of a print media substrate, such as a sheet of paper, by applying a potential to the sheet. The sheet and image are conveyed away from the photoreceptor 30 to the fuser assembly 16, which fuses the image to the sheet. The fuser assembly 16 generally applies at least one of heat and pressure to the sheet to physically attach the toner and to provide a level of gloss to the printed media. Meanwhile, the photoreceptor 30 rotates to the cleaning device 44, which removes residual toner and charge from the photoreceptor 30, ready for beginning the process again. In general, the number of rotations of the photoreceptor 30 is proportional to the number of copies (prints) made, for example, each rotation of the photoreceptor drum may correspond to one copy (or other determinable number of copies).

The printer shown in FIG. 1 is an illustrative example. In general, any number of print media sources 18, marking engines 14, finishers 20, or other operating components can be connected together by a suitable print media conveyor system 22. In some embodiments, the printer may be a cluster of networked or otherwise logically interconnected printers each having its own associated print media source and finishing components.

In addition to the applicability to different replacement modules of an electrophotographic printer, the principles are also applicable to replacement modules of other types of printer. For example, in an ink jet printer employing liquid or solid inks (a hot melt device), the replaceable module may be one or more of a drive system for the printhead, the printhead itself, a transfer drum, drum motor, drum maintenance unit (DMU), or the like. Moreover, it is to be appreciated that a printer may include multiple marking engines under the control of a CPU 10 and that there may be a plurality of replaceable modules of the same type in a printer.

Some replaceable unit 14, 16 may include a customer replaceable unit monitor (CRUM) 60, 62, respectively, comprising memory that stores information pertaining to the respective replacement module 14, 16, as described more fully in U.S. Pat. No. 6,016,409 to Beard, et al., and U.S. Pat. No. 6,532,351, to Richards, et al., the disclosures of which are incorporated herein in their entireties by reference. While the memory is described with reference to a CRUM, it is noted that the same information is and can be maintained in memory module 12 which resides in the printer. Each CRUM 60, 62 is capable of retaining information for the particular replaceable module 14 or 16 about how that replaceable module is being used within a printer. Data is entered and retained on the CRUM and also periodically updated. Thus, if a particular replaceable module 14, 16 is removed from a printer, the information will stay with the replaceable module. By reading the data that is retained within a CRUM at a particular time, certain use characteristics of the replaceable module 14 or 16 can be discovered. In the exemplary embodiment, the CRUM memory stores the end of life value (e.g., maximum number of copies which can be printed with the respective replaceable module or maximum pixel usage) and the cumulative value which varies as a function of the usage of the CRU and which generally represents the current status of the replaceable module 14, 16 with respect to the end of life parameter. For example, the stored cumulative value may be the print count (the number of copies which have been created by a particular replaceable module 14 or 16, or the total pixel usage), periodically updated through the CPU 10.

In some embodiments, the CRUM 60, 62 may store multiple end of life values, each representing a different parameter, and multiple cumulative values, one for each of the end of life values. In this embodiment, the end of life of the module may occur when any of the cumulative values reaches the respective end of life value or when a function of two or more of the cumulative values reaches a predetermined value.

The cumulative value and maximum value of the end of life parameter stored in the CRUM 60, 62 are generally resistant to tampering, which prevents a customer from changing the end of life value or cumulative value to artificially extend the life of the CRU 14, 16. The end of life reserve feature of the present embodiment provides an override to the general rule when an identifier provided by the supply center is input to the CPU 10. In one embodiment the CRUM memory stores a reserve end of life value or information from which a reserve life value can be determined. The stored value or information may be accessible to the CPU once the identifier is input. In another embodiment, the CPU stores the reserve life value in memory 12 or includes processing instructions for determining an end of life value. Optionally, the new EOL may be written to the CRUM. Or, a flag may be set in the CRUM to indicate that the reserve life has been used.

The exemplary CPU 10 includes an image processing component 70, a counter 72 and an end of life controller 74, all in communication with memory 12 via a data/control bus 76. Memory 12, as noted above, stores a control program to control overall operation of the printer. The image processing component 70 receives an input print job comprising one or more images to be printed from an image input device 78. The image input device 78 can comprise a built-in optical scanner, which can be used to scan a document such as book pages, a stack of printed pages, or the like, to create a digital image of the scanned document that is reproduced by printing operations performed by the printer. Alternatively, a print job can be electronically delivered to an interface unit of the printer via a wired or wireless connection to a digital network that interconnects, for example, personal computers or other digital devices 78.

A graphical user interface 80 in communication with CPU 10 includes a display unit 82, such as an LCD screen, which displays notification messages such as important message 86 that notifies the user that a premature consumable replacement event has occurred, in response to a user command and/or the control of the CPU 10. In the exemplary embodiment, the graphical user interface 80 also allows a user to select printing/copying parameters, such as number of copies to be made. A user input device, such as touch screen 82 of the graphical user interface 80 or an associated keypad 84, enables a user to input an identifier for accessing the reserve life. Other user input devices, such as one or more of a keyboard, computer mouse, touch pad, or touch screen, either on the printer or linked thereto via a network, are also contemplated. The graphical user interface 80 also shows graphical information about the replaceable component such as by showing a yield rate gauge 85 which shows the life remaining on the consumable as a percentage. A 100% indicates that the consumable is at full capacity, while 0% indicates that consumable has been depleted. The gauge can be made blank, display a solid color, or blink with a color when the yield rate is less than (L.T.) zero. In the example shown, yield rate gauge 85 may be a graphic indicating the relative level of toner, in which a taller graphic represents a higher level of toner. The graphic may also display a scale indicator, showing various gradations or levels, such as 100% remaining (full), 50% remaining, and 0% remaining (empty).

The image processing component 70 converts the received image to a form in which it can be rendered by the marking device 14, a process generally known as raster image processing in a xerographic device. In doing so, the image processing component 70 generates end of life information regarding one or more end of life parameters, such as the number of copies to be printed, the number of pixels to be printed, the amount of toner to be consumed, fuser operating parameters, or the like. The information may be stored in volatile memory 12. The information may be updated by new end of life information, e.g., as additional print jobs are received. The counter 72 increments the stored cumulative value of the end of life parameter, based on the information from the image processing component 70 which has been stored in memory 12 and stores the new cumulative value of the end of life parameter as well as the maximum value in memory 12. The end of life controller 74 periodically updates the cumulative value stored in memory 12 based on information from the counter 72. Accordingly, every time the printing machine performs an operation, a data point reflecting the operation just performed may be stored in memory 12. Once data is stored in the memory 12 over a period of time, the data may then be made available to users for retrieval. This data may be used, for example, to determine or derive usage of the particular consumable. The retrieved data is then used to determine CRU consumption, an end-of-life value for a component such a toner bottle, and other parameters or values well known to those in the art.

The end of life controller 74 is in communication with the graphical user interface 80 for displaying notification messages on screen 82, e.g., a first notification message (a "reorder module" message) when the end of life of a replaceable module 14, 16 is close to being reached, e.g., from five to seven days prior to the estimated end of life or within a predetermined number of copies from the end of life number, a second notification message when the end of life value is reached indicating that printing is no longer available, or in case where the consumable has been replaced prematurely a message indicative of such an event and possible an indication that the user is in violation with a purchase agreement. Additional notification messages may be provided, depending on user preferences, such as messages which provide a warning of an upcoming replacement in advance of the replacement notification and a warning of the impending hard stop one to two days prior to the expected end of life. The end of life controller 74 could also serves to disable printing functions when a predetermined value is reached unless a password or other identifier is received. The processing components 70, 72, 74 of the printer CPU 10 may all execute instructions stored in memory 12. As will be appreciated, components 70, 72, 74 may be combined or split into separate components and need not all be located within a single CPU 10.

Figure 2:
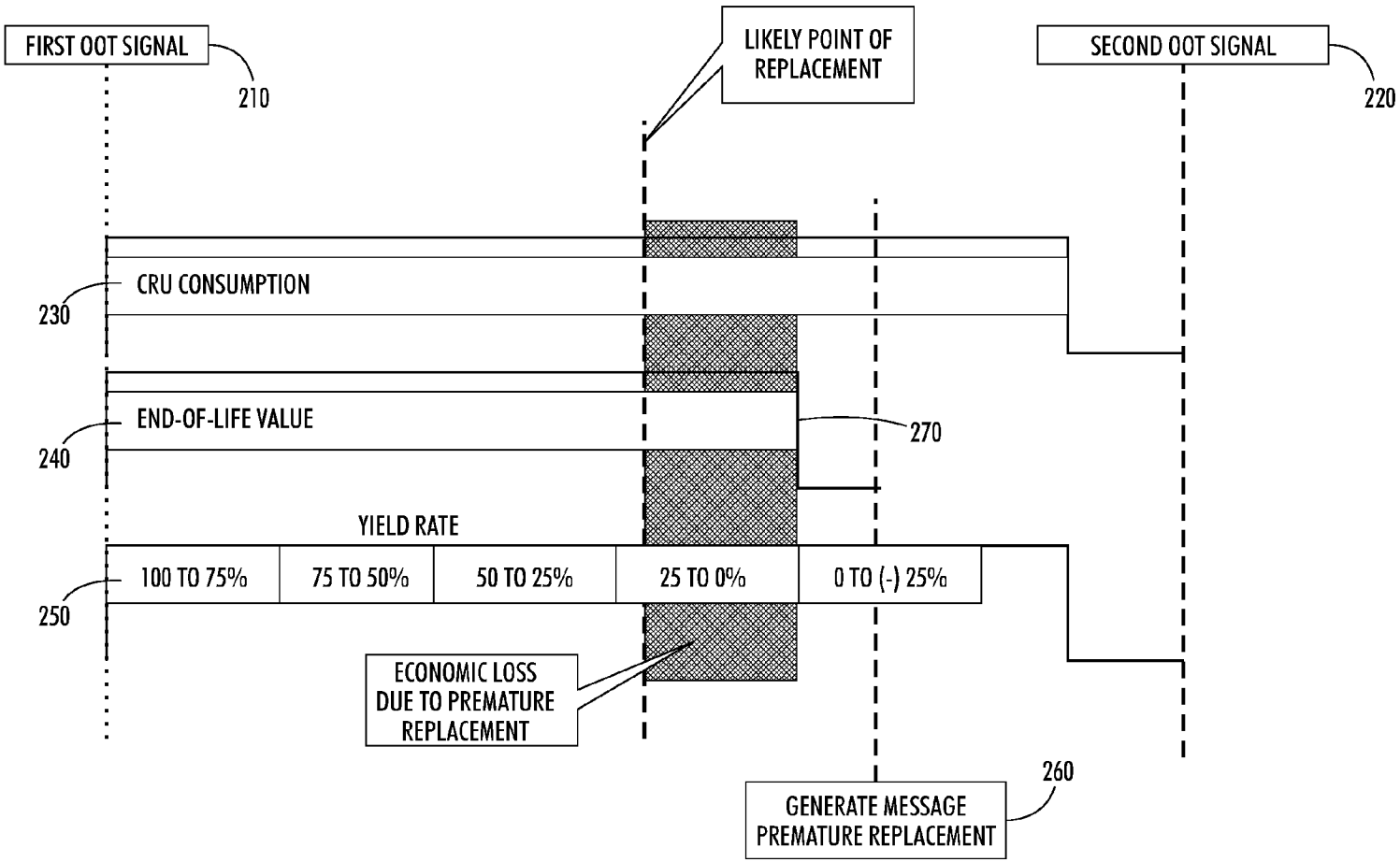
FIG. 2 is a pictorial representation of the relationship between consumption, end of life of the consumable, and premature replacement in accordance to an embodiment.

FIG. 2 is a pictorial representation of the relationship between consumption, end of life of the consumable, and premature replacement in accordance to an embodiment. In the following description a toner cartridge, atoner bottle, and a toner drum are collectively referred to as a "toner bottle". When the toner bottle is physically empty a first out of toner (OOT) signal 210 is detected. The OOT signal is ideal to use as a starting point for premature replacement detection since the content in the bottle is known and consumption of the consumable has not yet started. A second OOT signal 220 indicates an end of the premature replacement detection process. The ideal scenario is to have the user replace the toner bottle at the first OOT signal 210 and at the second OOT signal 220. However, it has been found that users do not always wait for the OOT message before changing the toner bottle. This premature replacement leads to an economic loss or wasting of toner that in the aggregate can add to a significant loss. For example, on the average a toner bottle is replaced at around eighty percent (80%) depletion or a bottle is discarded every five changes.

The monitoring of CRU consumption 230 is index to the first OOT signal 210 which makes it possible to ascertain the toner consumption starting at an arbitrary point such as the OOT signal. The toner consumption per pixel for different types of images is determined experimentally to estimate the toner consumption per page and subsequently remaining toner in the toner bottle. The toner mass consumption (grams) per pixel and ratio of transition counts/pixel counts for text, half tone and solid areas images will vary with the particular printer, and determined by counting pixels and transitions and measuring toner usage for different types of image in a test machine (under conditions of suitable area image coverage and density). At the first OOT signal 210 the usage gage is set to zero (0) and then is incremented up based on printing activities. Printing is conducted and toner usage is monitored to determine the quantity used. It is important to note that by monitoring toner usage any analysis of premature replacement is not depended on bottle content level.

At the start of a new bottle of toner which coincides with the first OOT signal 210 an end-of-life value (EOLV) 270 is determined. It is important in the detection of premature replacement that the EOLV be in the same dimension as the CRU consumption 230 value in order to do a proper comparison. The end of life value as used herein represents a theoretical point at which the consumable is no longer capable of performing at the expected level. So, if a toner bottle has end of life approximately N pages, and it is estimated that m pages are required for the present job, then the incremental depletion value could be determined as m/N, for example. The EOLVs for various toner bottle can be digitally stored in a look-up table in memory 12. Alternately, a suitable multiplier, could alternately be retrieved instead of the EOLV, and the end-of-life later calculated using the multiplier. The actual end-of-life of a toner bottle (i.e., the content in the bottle) is known from experience to regularly and reliably occur at a point very near some calculated end-of-life value. As a precaution, however, safety factor used for determining the practical end-of-life of the toner cartridge might be in the range of 1.10 to 1.2 of the EOLV taken from a look-up table. In one embodiment, a determination of premature replacement is not generated unless CRU consumption exceeds the EOLV by at least ten percent (10%). As a general rule, a toner bottle can range from 300 gram to 1600 gram. Regardless of the amount the EOLV is decremented by the amount of toner consumed in performing the various printing functions.

The yield rate 250 is the toner consumption per bottle and is calculated based on the estimated amount of toner delivered (CRUC 250) from a known bottle quantity (Max EOLV 240) at the point when the current bottle goes empty. The yield rate is then displayed as a gauge 85 on the user interface 82. As it can be seen the yield rate decreases with an increase in consumption of the toner. At the beginning of the process the yield rate is one hundred percent (100%) since the consumption is zero. While EOLV 240 is a number representing the theoretical amount of toner contained in the bottle, the yield rate 250 is the amount of toner expressed as a percentage. At point 270 the toner at the beginning of the process, max ELOV, should have been transferred to CRU consumption 230. The yield rate should coincide with zero percent (0%) and a second OOT 220 signal should have been generated instructing the user to replace the toner. However, because of premature replacement CRU replacement 220 continues to increase and the yield rate starts to become negative since the value for cumulative CRU consumption 230 is larger than max ELOV. In the event that CRU consumption continues to increase and there has been a second OOT signal a message indicating premature replacement can be generated 280. When taking the safety factor into account a message is not generated until CRU consumption is between 110% of max ELOV and 120% of max ELOV. In the case of a robust estimate for the initial value of toner then the message could be generated as soon as the CRU consumption 230 is equal to the max ELOV, when ELOV is equal to zero, or when the yield rate 250 is less than or equal to zero.

Figure 3:
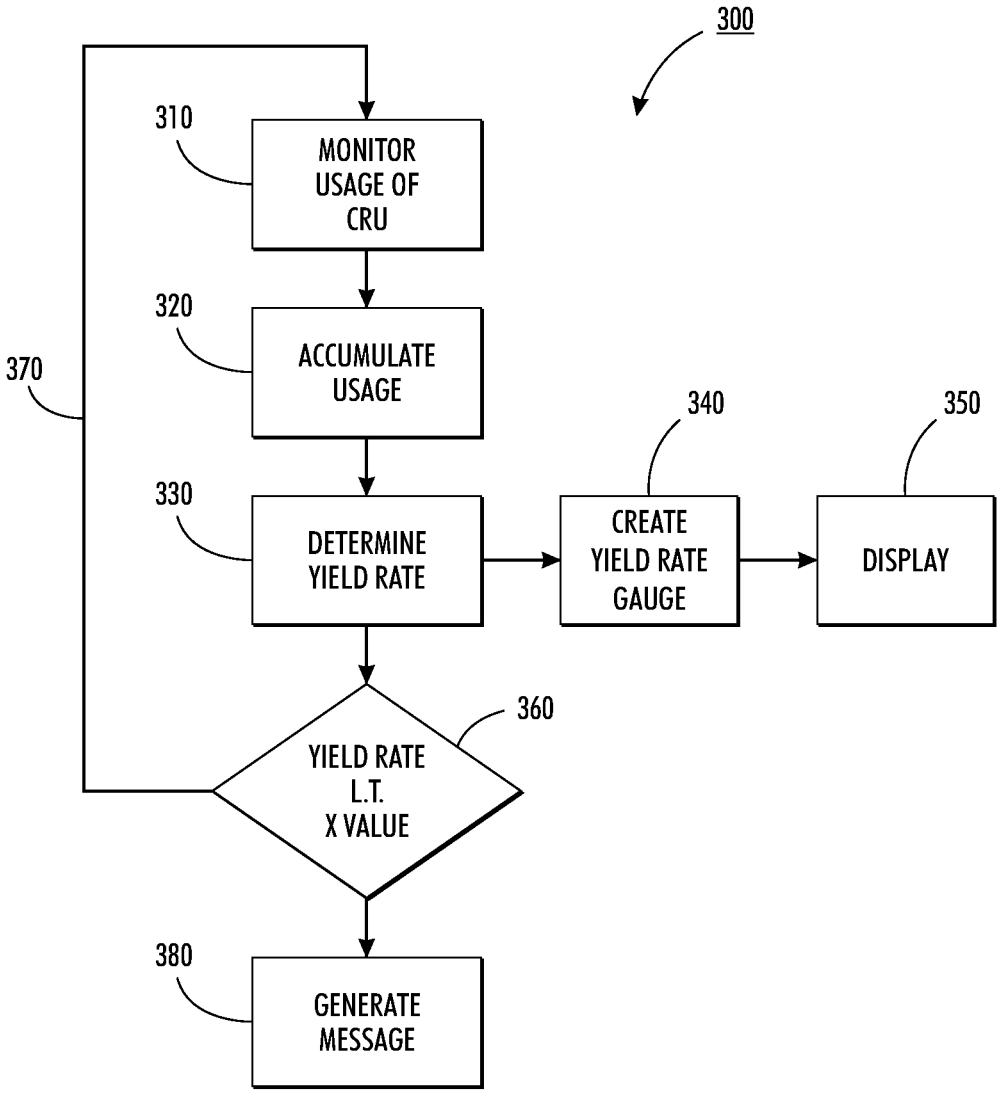
FIG. 3 is a flow chart of a method of detecting when a CRUM-less toner bottle is replaced before end of life (EOL) in accordance to an embodiment.

FIG. 3 is a flow chart of a method 300 of detecting when a CRUM-less toner bottle is replaced before end of life (EOL) in accordance to an embodiment. Method 300 begins with action 310 by monitoring the usage of the CRU. If the printing machine uses a dispensing motor, monitoring the accumulated dispense motor pulse count can be used to determine the nominal dispense rate is per unit of dispense pulse time of the consumable such as toner. More specific estimations can be achieved by applying optional correction factor(s) that factor in foreseen deviations, such as a reduction in toner dispensing during each initial motor start up cycle and compensation for extra toner dispensing during the run on time caused by inertia acting on the motor during and after a motor pulse. In action 320, the usage of the CRU monitored in action 310 is then accumulated. The accumulation is stored in storage device such as memory 12 in raw form or in processed form indicating the usage of toner since the first OOT signal 210. Control is passed to action 330 where a yield rate is calculated from the accumulated usage (action 320) and the max end-of-life value which represents a known bottle quantity at the start of the process. Control is then passed to action 340 where a yield rate gauge is created from the determined yield rate of action 330. The yield rate Gauge shown as 85 in FIG. 1 can take various forms in order to provide an indication of remaining toner quantities. As shown in FIG. 1, the graphic (yield rate gauge 85) indicates the relative level of toner, in which a taller graphic represents a higher level of toner. The graphic may also display a scale indicator, showing various gradations or levels, such as 100% remaining (full), 50% remaining, and 0% remaining (empty). Alternatively, the yield rate gauge 85 may be a digital numeric display, indicating the percent of toner remaining and/or the number of days of toner supply remaining. In action 350 the yield rate gauge is displayed. When the yield rate is less than or equal to 0% but greater than an "X" value the yield rate gauge is left blank or a suitable icon could be selected in its place.

While the yield rate gauge is being created and displayed a determination is made in decision block 360 to ascertain if the Yield rate is below a certain "X" value. The "X" value can be the zero (0%) remaining (empty) value or a value chosen in accordance to some predetermined criteria. In one embodiment the "X" value is chosen to be between −10% to −20% of the yield rate. If the user uses more that 110% of the tones in the bottle the system is confident that there has been a premature replacement. Control is then passed to action 380 where a message is generated indicating premature replacement of the toner bottle. The message can be a warning indicator on display unit 82 or it can take such forms as an email message, a short message service message, an instant message, and an electronic document. The message can be forwarded to vested participants of the printing machine such as the user, the owner, the manager, and in the case of a metered machine to the print management station. The message and the accumulation of messages could be used by the parties to negotiate a purchase of at least one machine. If the yield is greater than the "X" vale then control is returned (370) to action 310 and the latest value for CRU usage is ascertained and accumulated.

Figure 4:
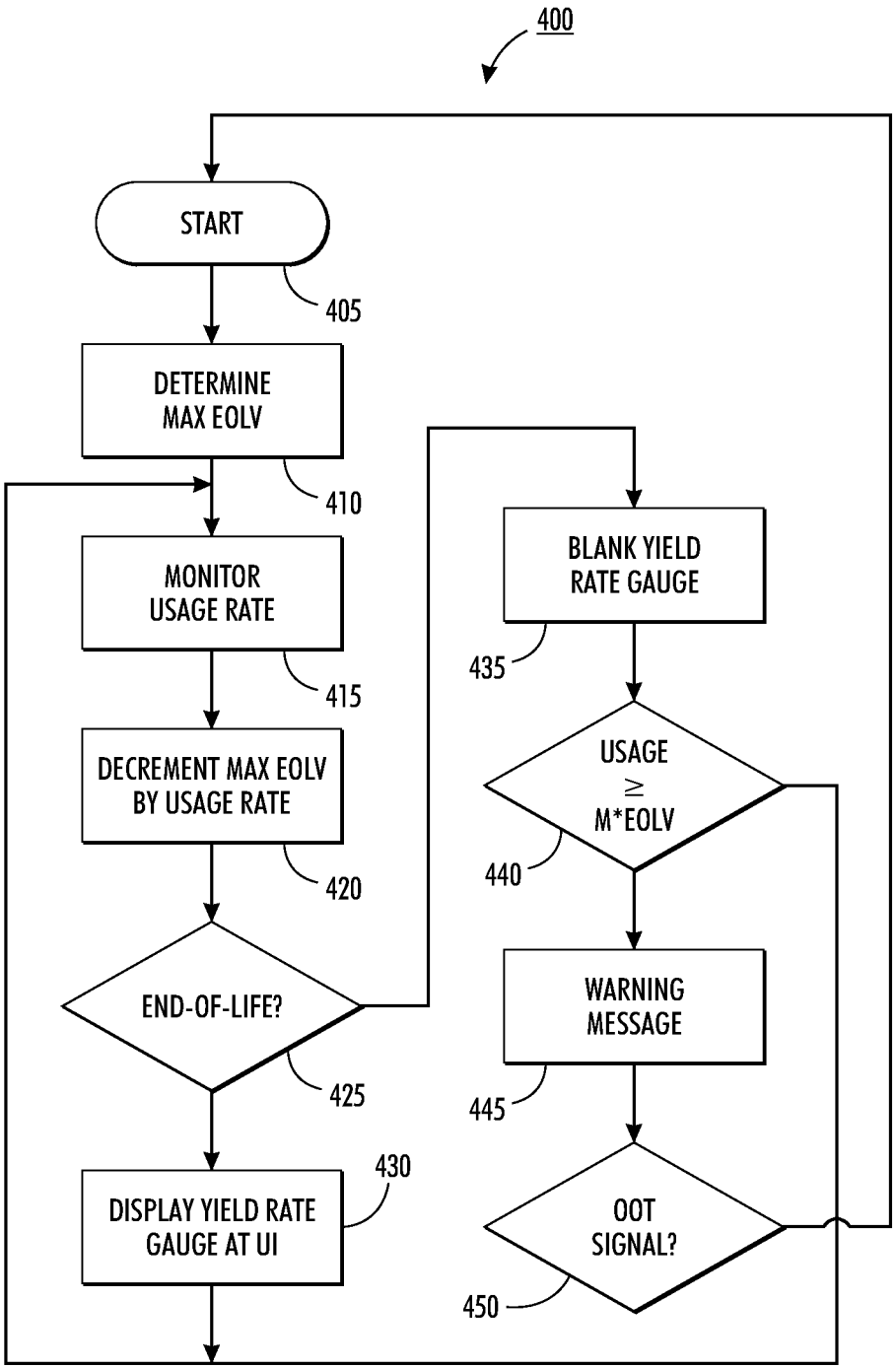
FIG. 4 is a flow chart of a method for creating a yield rate gauge for at least one replaceable module and using a determined yield rate to generate a message in accordance to an embodiment.

FIG. 4 is a flow chart of a method 400 for creating a yield rate gauge for at least one replaceable module and using a determined yield rate to generate a message in accordance to an embodiment. Method 400 begins with action 405 which starts the process for creating a yield rate gauge for at least one replaceable module and for using a determined yield rate to generate a message. Action 405 could be a signal indicative of toner replacement in answer to the first OOT signal 210 or it could be a pulse from a dispensing motor after an out of toner signal. Control is then passed to action 410 where a maximum end-of-life value is determined. Each consumable is manufactured with a maximum count, reflecting the maximum number of images/pages that can be produced by the consumable. The toner bottle is received pre-filled with a specified (known constant) initial amount of toner, which is known to the printer. That number may be stored as a pixel count or an actual toner weight in the CPU/processor 10. The count or weight is stored in memory 12 as the max EOLV. Control is then passed to action 415 where the usage rate is monitored. Usage rate can be determined from counting the number of pixels required or produced on a print job. The total number of pixels on a page (count per page) is then multiplied by a factor to arrive at the toner mass consumption per page. In action 420 the resulting calculated toner amount is subtracted from the end-of-life value. In action 425 the method determines if the end-of-live for the consumable has been reached. Since the ELOV is being decremented by the usage rate, action 425 uses the difference to determine if an end-of-life event has occurred. That is, if the difference is substantially zero we can assume that the consumable has been depleted. If the end-of-life of the consumable has not been reached then control passes to action 430 where the usage gauge is displayed at the user interface as yield rate gauge 85. After displaying the usage gauge at the user interface (UI) control is passed back to action 415 for further processing. If the end-of-life of the consumable has been reached then control is passed to action 435 where the usage gauge (yield rate gauge 85) is left blank on the user interface. In action 440, the usage is compared to a multiple (M) of the end-of-life value (EOLV), where "M" is in the range of 110% to 120%. In the alternative, the method could use action 420 to determine if the difference has exceeded the initial quantity by the "M" multiple. If the determination in action 440 is "YES" then ay action 445 a warning message is generated indicating that a premature replacement has occurred. The warning message at action 445 is re-generated until the system is reset by receiving of an OOT signal at action 450. IF the usage is not at a certain rate then control is passed to action 415 for further processing and the warning message of action 445 is not generated but the usage gauge is still kept blank because the consumption has exceeded the consumable's end-of-life as determined by action 425.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

It is believed that the foregoing description is sufficient for purposes of the present application to illustrate the general operation of an electrophotographic printing machine. Moreover, while the present invention is described in an embodiment of a single color printing system, there is no intent to limit it to such an embodiment. On the contrary, the present invention is intended for use in multi-color printing systems as well, or any other printing system having a cleaner blade and toner. It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the followings claims.

What is claimed is:

1. A method to detect premature consumable replacement of a consumable replaceable unit in a printer, the method comprising:

monitoring and accumulating usage of the consumable replaceable unit in the printer;

determining a yield rate from the accumulated usage of the consumable replaceable unit in the printer;

generating a message indicative of premature consumable replacement if the yield rate for the consumable replaceable unit is below a certain value.

2. The method according to claim 1, the method further comprising:

displaying the yield rate as a gauge on a printer user interface.

3. The method according to claim 2, wherein below a certain value is less than or equal to zero.

4. The method according to claim 3, wherein the message is displayed on the printer user interface.

5. The method according to claim 3, wherein the generated message notifies the user that a premature consumable replacement is a potential violation of a service level agreement that exists with an enterprise.

6. The method according to claim 3, wherein the consumable replaceable unit is selected from a group consisting of toner cartridge, ink stick, ink bottle, and print media.

7. The method according to claim 6, wherein the yield rate is a function of consumption of the consumable replaceable unit, end of life value for the consumable replaceable unit, and a first and second triggering signal.

8. A system to detect premature consumable replacement of a consumable replaceable unit in a printer comprising:

a processor;

a storage device coupled to the processor, wherein the storage device comprises program instructions executable by the processor to:

monitor and accumulate usage of the consumable replaceable unit in the printer;

determine a yield rate from the accumulated usage of the consumable replaceable unit in the printer;

generate a message indicative of premature consumable replacement if the yield rate for the consumable replaceable unit is below a certain value.

9. The system according to claim 8, wherein the storage device further comprises program instructions executable by the processor to:

display the yield rate as a gauge on a printer user interface.

10. The system according to claim 9, wherein below a certain value is less than or equal to zero.

11. The system according to claim 10, wherein the message is displayed on the printer user interface.

12. The system according to claim 10, wherein the generated message notifies the user that a premature consumable replacement is a potential violation of a service level agreement that exists with an enterprise.

13. The system according to claim 10, wherein the consumable replaceable unit is selected from a group consisting of toner cartridge, toner bottle, ink stick, and print media.

14. The system according to claim 13, wherein the yield rate is a function of consumption of the consumable replaceable unit, end of life value for the consumable replaceable unit, and a first and second triggering signal.

15. A printer comprising:

at least one replaceable module which is removable from the printer; and a processor having a first mode of operation to display, until the processor determines that an end of life value for the replaceable module is reached, a yield rate gauge for the at least one replaceable module and a second mode of operation to display, if operation of the printer continues beyond a certain value past the end of life value for the replaceable module, a message indicative of premature consumable replacement.

16. The printer according to claim 15, further comprising a graphical user interface in communication with the processor which displays the yield rate gauge and the message indicative of premature consumable replacement.

17. The printer according to claim 16, wherein certain value past the end of life value is less than or equal to zero.

18. The printer according to claim 17, wherein the generated message notifies the user that a premature consumable replacement is a potential violation of a service level agreement that exists with an enterprise.

19. The printer according to claim 18, wherein the replaceable module is selected from a group consisting of toner bottle, toner cartridge, ink stick, and print media.

20. The printer according to claim 19, wherein the yield rate is a function of consumption of the replaceable module, end of life value for the replaceable module, and a first and second triggering signal.

* * * * *